US008662185B2

(12) United States Patent
Gette

(10) Patent No.: US 8,662,185 B2
(45) Date of Patent: Mar. 4, 2014

(54) ACTIVE CASING HANGER HOOK MECHANISM

(75) Inventor: Nicholas Peter Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 545 days.

(21) Appl. No.: 12/979,220

(22) Filed: Dec. 27, 2010

(65) Prior Publication Data

US 2012/0160511 A1 Jun. 28, 2012

(51) Int. Cl.
*E21B 23/00* (2006.01)

(52) U.S. Cl.
USPC ..... 166/368; 166/341; 166/348; 166/382; 166/75.14; 285/123.1

(58) Field of Classification Search
USPC ..... 166/368, 341, 348, 360, 380, 382, 85.1, 166/75.14; 285/123.1, 123.4
See application file for complete search history.

(56) References Cited

U.S. PATENT DOCUMENTS

| | | | | |
|---|---|---|---|---|
| 4,641,708 | A * | 2/1987 | Wightman | 166/208 |
| 4,665,979 | A * | 5/1987 | Boehm, Jr. | 166/208 |
| 4,836,579 | A * | 6/1989 | Wester et al. | 285/3 |
| 5,127,478 | A * | 7/1992 | Miller | 166/348 |
| 5,174,376 | A * | 12/1992 | Singeetham | 166/208 |
| 5,209,521 | A * | 5/1993 | Osborne | 285/3 |
| 5,607,019 | A * | 3/1997 | Kent | 166/344 |
| 6,012,519 | A * | 1/2000 | Allen et al. | 166/75.14 |
| 6,516,887 | B2 * | 2/2003 | Nguyen et al. | 166/348 |
| 7,150,323 | B2 * | 12/2006 | Ford | 166/348 |
| 7,234,528 | B2 * | 6/2007 | Pallini et al. | 166/343 |
| 7,380,607 | B2 * | 6/2008 | Thomas | 166/348 |
| 7,441,594 | B2 * | 10/2008 | Vanderford et al. | 166/75.14 |
| 2008/0308278 | A1 * | 12/2008 | Adamek et al. | 166/348 |
| 2010/0089590 | A1 * | 4/2010 | Dyson et al. | 166/382 |
| 2011/0253389 | A1 * | 10/2011 | Nguyen | 166/382 |

FOREIGN PATENT DOCUMENTS

| | | | |
|---|---|---|---|
| GB | 2253870 | A | 9/1992 |
| GB | 2269414 | A | 2/1994 |
| GB | 2415212 | A | 12/2005 |
| GB | 2435488 | A | 8/2007 |

OTHER PUBLICATIONS

GB Search Report dated Feb. 28, 2012 from corresponding Application No. GB1121638.9.

* cited by examiner

*Primary Examiner* — Matthew Buck
(74) *Attorney, Agent, or Firm* — Bracewell & Giuliani LLP

(57) ABSTRACT

A subsea wellhead assembly includes a housing with a bore. A hanger is lowered into the housing, the hanger having at least one centralizing finger with a hook for engaging a corresponding hook an activation ring carried by the hanger via a shear pin. A load ring is carried on the hanger and supported initially within a recess formed on the exterior of the hanger. At the correct depth within the housing, coinciding with a shoulder on the inner diameter of the housing, the pin is sheared under the weight of the casing string and the hooks disengage to allow the load ring on the hanger to slide outward and create a path for the casing load to be transferred from the hanger to the hanger load ring, to a housing load ring, and ultimately the housing.

18 Claims, 8 Drawing Sheets

ACTIVE CASING HANGER HOOK MECHANISM

FIELD OF THE INVENTION

This invention relates in general to wellhead equipment for oil and gas wells, and in particular to a casing hanger centralizing mechanism.

DESCRIPTION OF RELATED ART

A typical subsea wellhead assembly includes a wellhead housing that supports one or more casing hangers. One type of wellhead housing has a conical load shoulder machined within its bore. The casing hanger lands on and is supported by the load shoulder. In this type, the diameter of the housing bore below the load shoulder is less than the diameter of the housing above the load shoulder by a dimension equal to a radial width of the load shoulder.

In another type, referred to as "full bore", the wellhead housing has a groove with substantially the same diameter above and below the groove. The load shoulder is a split ring that is installed subsequently in the groove. The casing hanger is supported by the load shoulder. This procedure allows a larger diameter bore to be employed during drilling operations. The load shoulder may be installed on a special running tool or it may be run with the casing hanger.

Active casing hangers may be used to transfer the casing load to the wellhead housing via a loading mechanism that includes an activation ring, shear pins that prevent premature movement of the activation ring, and a load ring on the casing hanger. This mechanism is typically designed to be activated by the weight of the string when a reaction point, such as a shoulder, formed on the interior of the wellhead housing is reached during lowering of the hanger. At this point, the shear pins on the activation ring break to allow it to slide relative to the downward movement of the hanger, thereby allowing the load ring on the hanger to align with the housing to transfer casing load to the housing. However, if the hanger snags or the pins load up unevenly and break prematurely, the activation ring may be activated prematurely. This is costly and time consuming as the hanger and casing would have to be pulled out and re-tripped.

A technique is thus desirable that correctly and reliably activates the loading mechanism on an active casing hanger to prevent premature activation.

SUMMARY OF THE INVENTION

In an example embodiment a wellhead housing has a bore containing at least one conical generally upward facing load shoulder that inclines relative to an axis of the bore. A housing load ring with a corresponding downward facing shoulder is supported by the load shoulder on the wellhead housing. The housing load ring has a generally upward facing shoulder that inclines relative to the bore axis. A tag shoulder is formed on an interior surface of the housing load ring. A casing hanger landed in the housing has a at least one conical downward facing load shoulder that inclines relative to the axis of the bore. A split load ring is carried by the hanger for supporting the hanger on the upward facing load shoulder. The load ring has an inner profile that slidingly engages the downward facing load shoulder of the hanger and an outer profile that slidingly engages the upward facing load shoulder of the housing load ring. The load ring is carried by the hanger for movement between a retracted position, wherein the outer profile is spaced radially inward from the upward facing shoulder of the housing load ring, and an expanded position wherein the outer profile is in engagement with the upward facing shoulder of the housing load ring. When set, the load rings and shoulders provide a path for the casing load to be transferred to the wellhead housing.

Further, the casing hanger has a centralizer ring comprised of segments or fingers. The fingers are fastened to the casing hanger at one end and have a hook at another end for engagement with a hook formed on a lower end of an activation ring. The fingers have a pivot or fulcrum point on an interior portion that contacts an exterior surface of the hanger. When fastened, the fulcrum point creates an outward spring effect that acts to centralize the hanger as it is lowered into the wellhead housing when it contacts the bore of the housing. A shear pin maintains the activation ring in place during installation until a corresponding tag shoulder on the activation ring comes into contact with the tag shoulder on the housing load ring. Additional downward force at this point causes the hook on the fingers to disengage from the hook on the activation ring and the pins to shear. Once the pins are sheared, the hanger and centralizing ring move downward independently of the activation ring, allowing the load ring carried by the hanger to slide radially outward into an expanded position. Once set in this position, casing load can be transferred through the casing hanger load ring, to the housing load ring, and to the wellhead housing via the load shoulder. The fingers of the centralizing ring advantageously prevent activation of the casing hanger until the correct location within the housing is reached.

BRIEF DESCRIPTION OF THE DRAWINGS

FIGS. 5A-4E are side sectional views of a deactivation sequence for retrieving the casing hanger of FIG. 1 from within the wellhead housing.

DETAILED DESCRIPTION OF THE INVENTION

Figure 1:
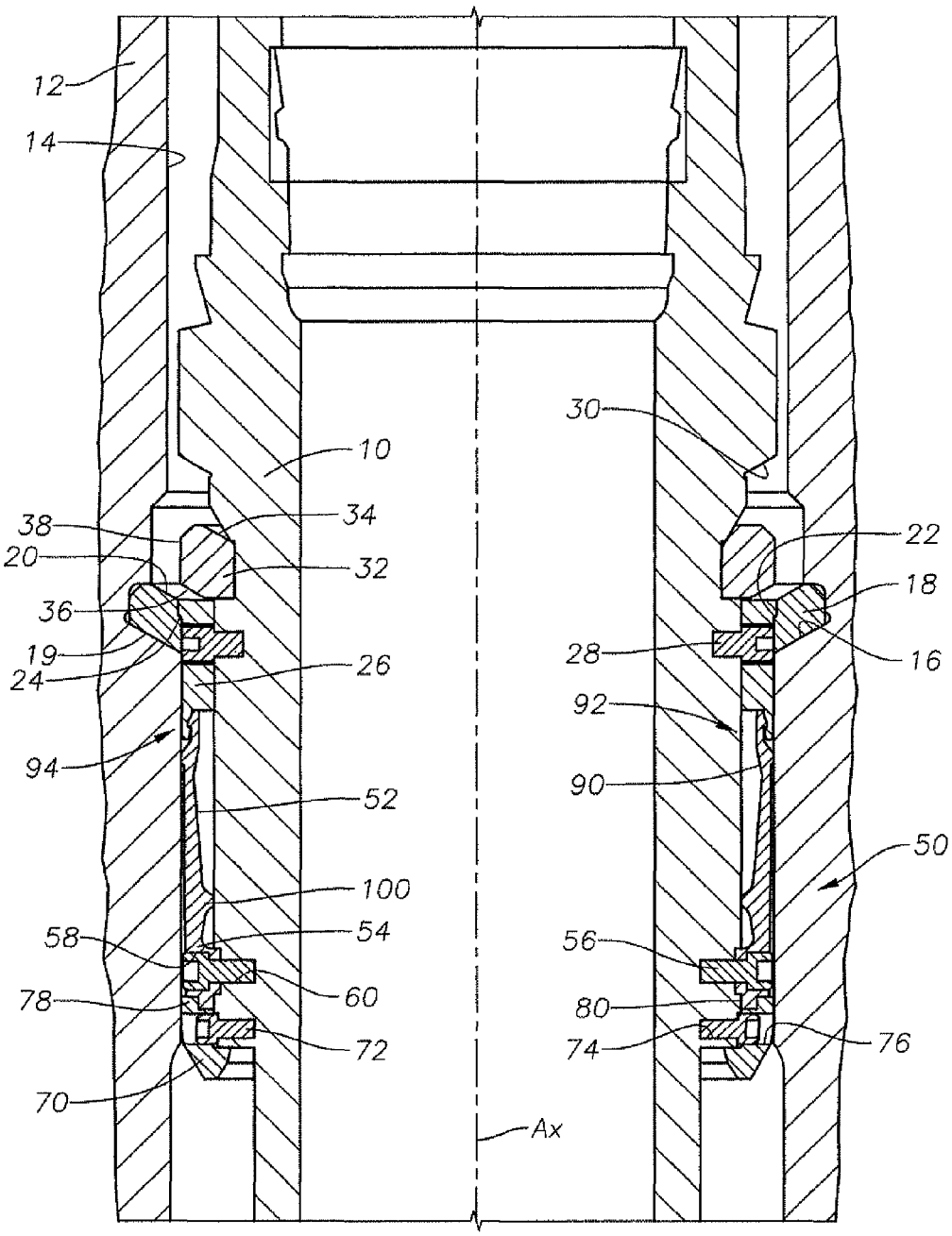
FIG. 1 is a side sectional view of a casing hanger and load ring carried on the casing hanger and shown within a wellhead housing in an unset position, and constructed in accordance with this invention.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Referring to FIG. 1, a casing hanger 10 is shown within a wellhead housing 12 having an axial bore 14. Bore 14 has an upward facing tapered shoulder 16 located formed within. In this embodiment, the shoulder 16 inclines relative to an axis of the bore 14. Shown resting on the shoulder 16 is an annular housing load ring 18 whose lower surface defines a downward facing shoulder 19 with a slope corresponding to the load shoulder 16. The upper surface of the housing load ring 18 has a generally upward facing shoulder 20 that inclines relative to the bore axis $A_X$. A tag shoulder 22 is formed on an interior surface of the housing load ring 18 that interacts with a corresponding downward facing shoulder 24 formed on an activation ring 26 carried by the hanger 10 by means of a shear pin 28. In this embodiment, tag shoulder 22 and downward facing shoulder 24 are correspondingly tapered and the activation ring 26 is cylindrical. The activation ring 26 may have an opening to receive the shear pin 28. When the tag shoulders 22, 24 contact each other, the activation sequence is initiated. The activation sequence will be discussed in further detail in a subsequent section.

Continuing to refer to FIG. 1, the casing hanger 10 has a at least one conical downward facing load shoulder 30 that inclines relative to the axis $A_X$ of the housing bore 14. A hanger load ring 32, which may be a split load ring, is carried on the outer circumference of the hanger 10 for supporting the hanger 10 on the housing load ring 18. The hanger load ring 32 has an upward facing, tapered shoulder 34, that as will be described in more detail below, slidingly engages the downward facing load shoulder 30 of the hanger 10. The hanger load ring 32 further includes a downward facing, tapered shoulder 36 that slidingly engages the upward facing load shoulder 20 of the housing load ring 18 when the housing load ring 18 is in an expanded position. The hanger load ring 32 in this embodiment is carried by the hanger 10 for movement between a retracted position, wherein an outer profile is 38 spaced radially inward from the upward facing shoulder 20 of the housing load ring 18, and the expanded position wherein the outer profile 38 is in engagement with the upward facing shoulder 20 of the housing load ring 18. When set, contact between the hanger 10 and housing load rings 32, 18 and shoulders 30, 20 transfer a load from the casing to the load shoulder 16 of the wellhead housing 12.

Figure 2:
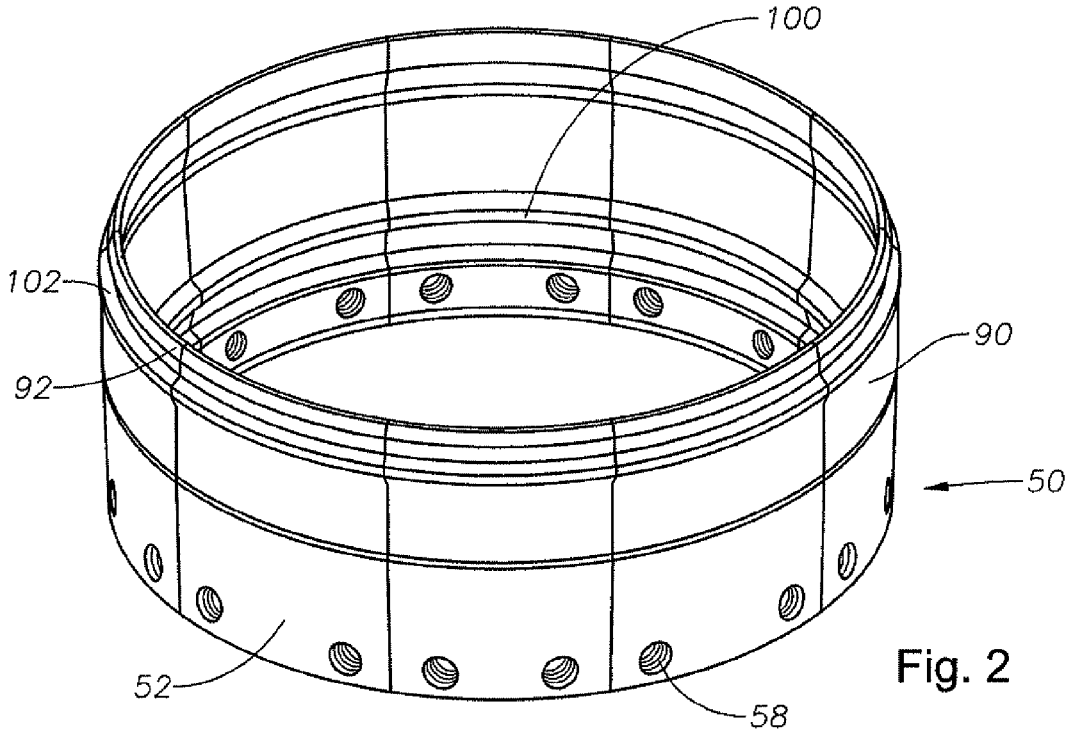
FIG. 2 is a perspective view of a centralizing ring comprising finger segments, in accordance with the invention.

Continuing to refer to FIG. 1, in this embodiment, a centralizer ring 50 having a plurality of segments or fingers 52 is shown. The centralizer ring 50 centralizes the casing hanger 10 and minimizes impact when it is lowered into the housing 12 A perspective view of the centralizer ring 50 is shown in FIG. 2 for clarity. The fingers 52 are fastened to the casing hanger 10 at a lower end 54 of the finger 52 with bolts 56 inserted through passages 58 (FIG. 2) formed at the lower end 54 of the finger 52 shown registering with passages 60 formed on the hanger 10. It is not necessary that all lower ends 54 of the fingers 52 be fastened to the hanger 10. This selective fastening allows for tuning of the amount of centralizing force provided. A lower portion 70 of the centralizing ring 50 forms a base that supports the fingers 52 in this embodiment. The lower portion 70 is fastened to the hanger 10 by bolts 72 shown inserted through passages 74 in the hanger 10 and corresponding passages 76 formed in the centralizing ring 50. A rim 78 that protrudes upward from the lower portion 70 may interfere with a lower extension 80 of the finger 52 to prevent the lower end 54 from sliding outward if it is not fastened to the hanger 10.

Figure 3:
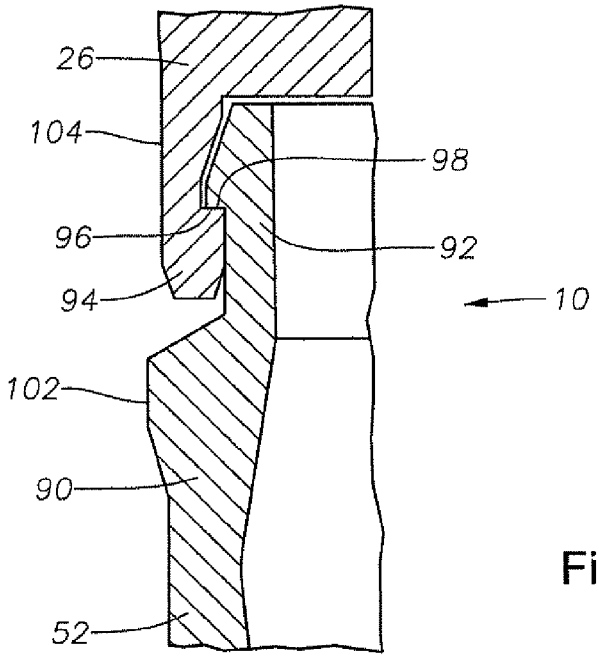
FIG. 3 is a side sectional view of a hook mechanism of a finger, in accordance with the invention.

A top end 90 of the finger 52 opposite to lower end 54 has a hook 92 shown facing radially outward for engagement with a radially inward facing hook 94 formed on a lower end of the activation ring 26. Referring to FIG. 3 for more clarity, a downward facing surface 96 on the finger hook 92 interferes with an upward facing surface 98 on the hook 94 of the activation ring 26. Thus the fingers 52 may be restrained at the lower end 54 by the bolt 56 and at the top end 90 by engagement of the hooks 92, 94. Depending on the amount torque applied to fasten the bolt 56, a spring effect can be created between the top end 90 and lower end 54 of the finger 52 due to a fulcrum 100 (FIG. 1) formed on an interior surface of the finger 52 that contacts the hanger 10 and forms a cantilever. The fulcrum 100 protrudes radially inward and forms a pivot point at the point of contact with the hanger 10. The outward spring effect on the top end 90 centralizes the hanger 10 as it is lowered into the wellhead housing 12. Further, the spring effect causes the hook 92 at the top end 90 to remain engaged to the hook 94 on the activation ring 26 when the fingers 52 of the centralizing ring 50 contact the bore 16 as the hanger 10 is lowered into the wellhead housing 12. As shown in FIG. 3, a pad or protrusion 102 formed on the upper end of the finger 52 protrudes radially outward beyond an outer surface 104 of the activation ring 26. This allows the pad 102 to come in contact with the bore 16 (FIG. 1) to centralize the hanger 10 while preventing the activation ring 26 from becoming snagged during the lowering of the hanger 10. If a finger 52 is not bolted to the hanger 10 at the lower end 54 and is captured by the rim 78 of the lower portion 70, the pad 102 on the exterior of the finger 52 will disengage the hooks 92, 94 when the pad 102 contacts the bore 14 of the housing 12.

Figure 4A:
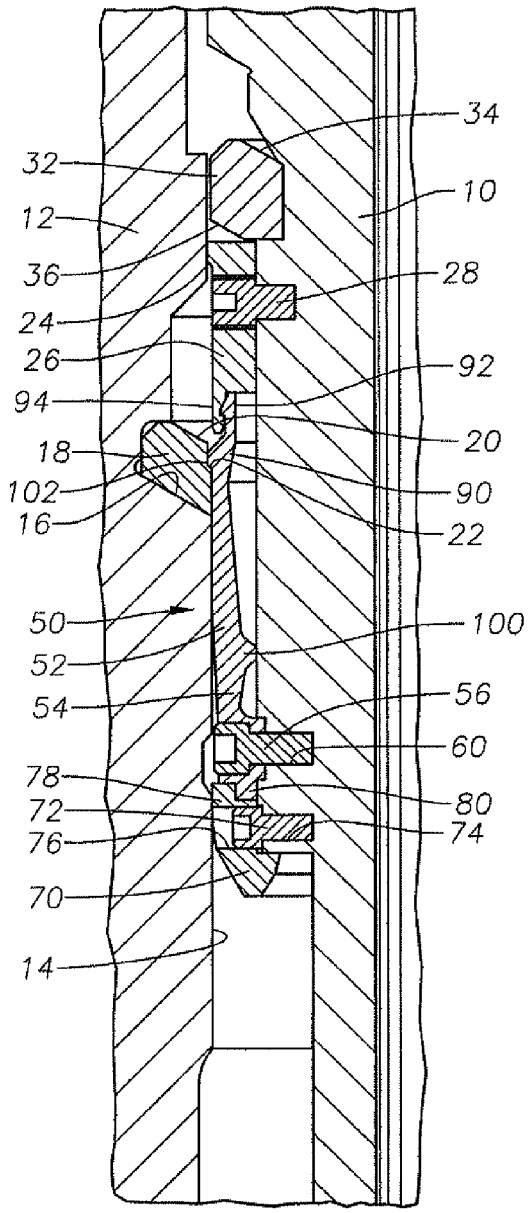
FIGS. 4A-4E are side sectional views of an activation sequence for setting the casing hanger of FIG. 1 within the wellhead housing.
Figure 4B:
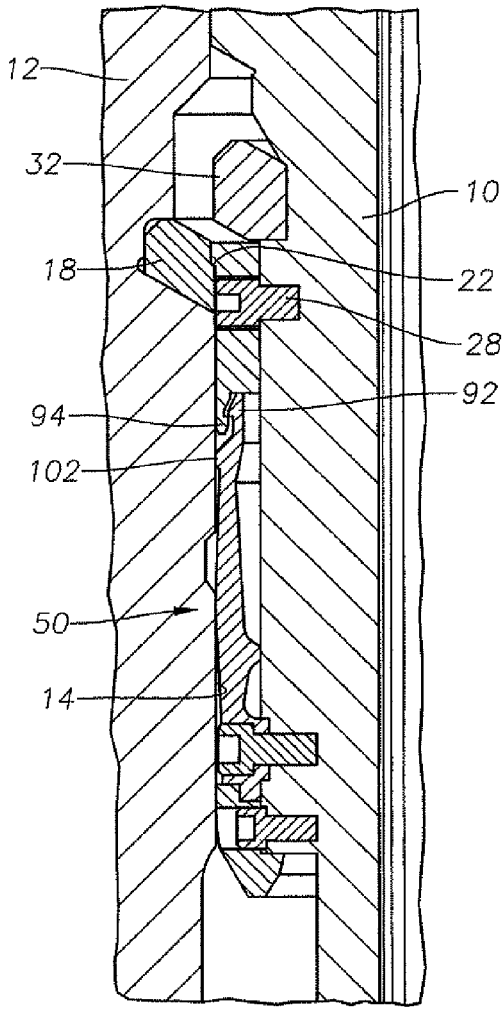
Figure 4C:
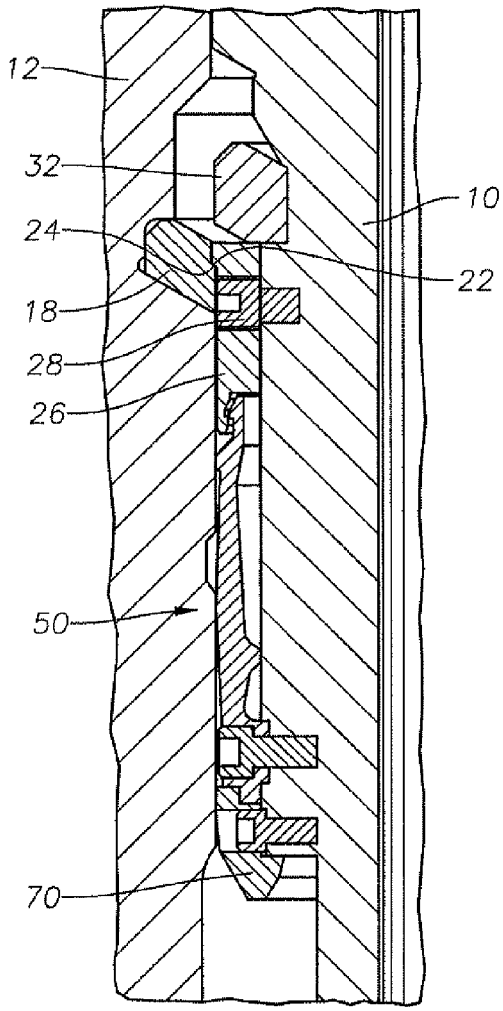
Figure 4D:
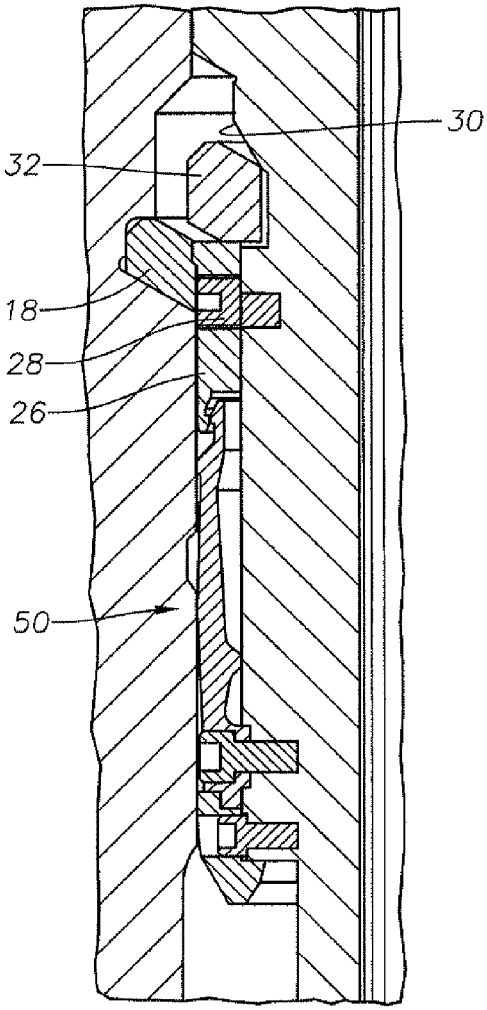
Figure 4E:
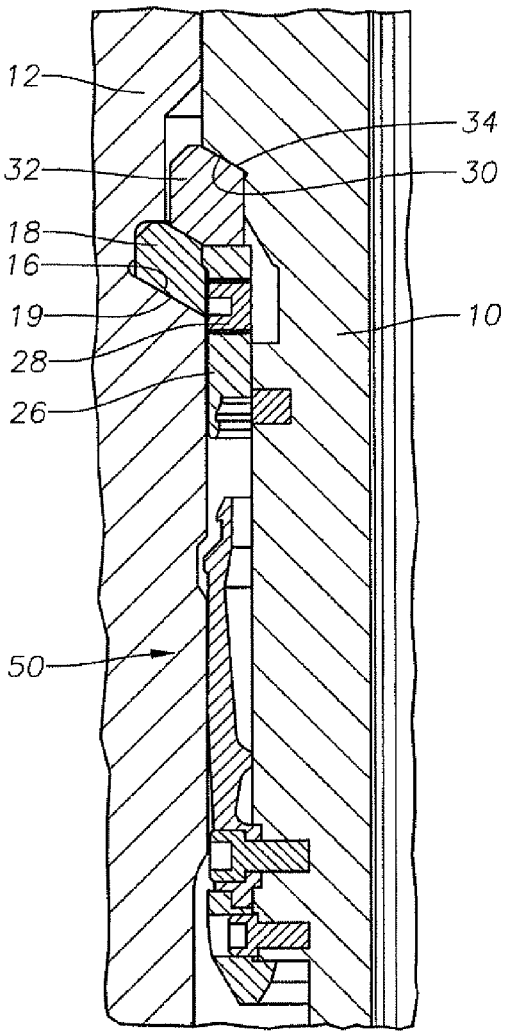

One example of installation of an embodiment of the casing hanger 10 is depicted in FIGS. 4A-4E. During installation, the casing hanger 10 may be lowered into the wellhead housing 12 by a running tool (not shown) as shown in FIG. 4A. As the hanger 10 is lowered, the fingers 52 of the centralizing ring 50 centralize the hanger 10 within the wellhead housing 12 by exerting an outward force against the bore 14 of the wellhead housing 12. The force is exerted by the spring effect loaded into the fingers 52 during assembly. The outward bowing of the loaded fingers 52 thus define a centralizer. The hanger 10 is lowered until the pad 102 (FIG. 3) contacts the upward facing tag shoulder 22. In an example embodiment, the tag shoulder 22 may be upset radially outward from the bore 14 by about ⅛". The remaining installation of the casing hanger 10 is accomplished via the weight of casing supported by the hanger 10; the weight of the casing supported by the hanger causes the hanger 10 to continue moving down. The hooks 92 disengage the hooks 94 as the pad 102 is urged radially inward through its contact with the bore 14 as shown in FIG. 4B. The hooks 92, 94 only disengage at the proper diameter of the bore 14 and may be designed to withstand a one million pound load before shearing. At this point, the downward facing tag shoulder 24 formed on the activation ring 26 contacts the upward facing tag shoulder 22 on the housing load ring 18. As shown in FIG. 4C, the interference between the tag shoulders 24, 22 creates a reaction point that allows additional casing weight that will eventually shear the shear pin 28. Referring to FIG. 4D, the shear pin 28 is shown having been sheared releasing the casing hanger 10 and the centralizing ring 50 to continue to move downward while the activation ring 26 remains engaged to the housing load ring 18 via the interference between the tag shoulders 22, 24. As the hanger 10 and centralizing ring 50 continue moving downward, the hanger load ring 32 is urged radially outward by the hanger 10 such that the hanger load ring 32 slides radially outward along a top surface of the activation ring 26 until the upward facing shoulder 34 slides into contact with the downward facing load shoulder 30 of the hanger 10 and the downward facing shoulder 36 of the hanger load ring 32 slides into contact with the upward facing shoulder 20 of the housing load ring 18, as shown in FIG. 4E. At this point, the hanger load ring 32 is fully set and is no longer in contact with the activation ring 26. The casing load may thus be transferred from the casing hanger 10 through the hanger load shoulder 30, to the hanger and housing load rings 32, 18, to the housing load shoulder 16 and ultimately the wellhead housing 12.

Figure 5A:
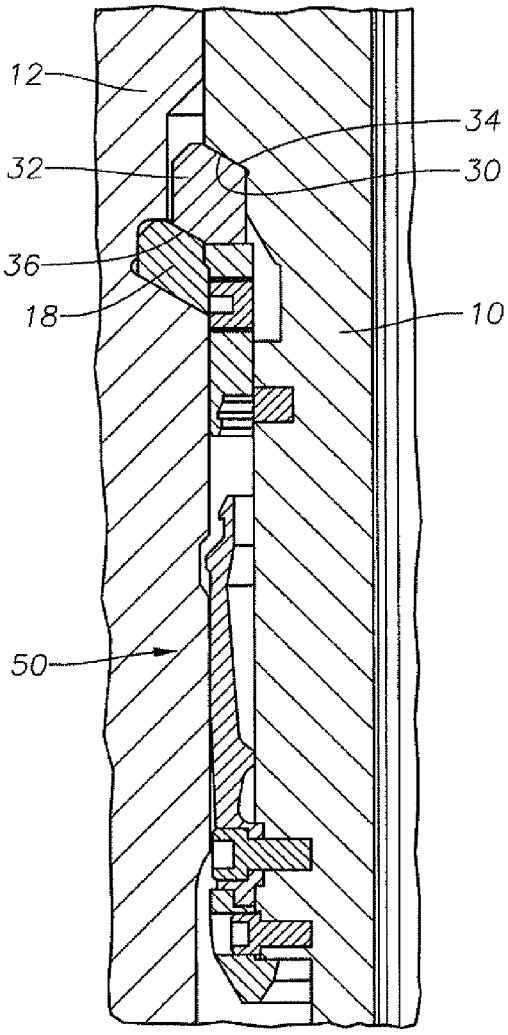
Figure 5B:
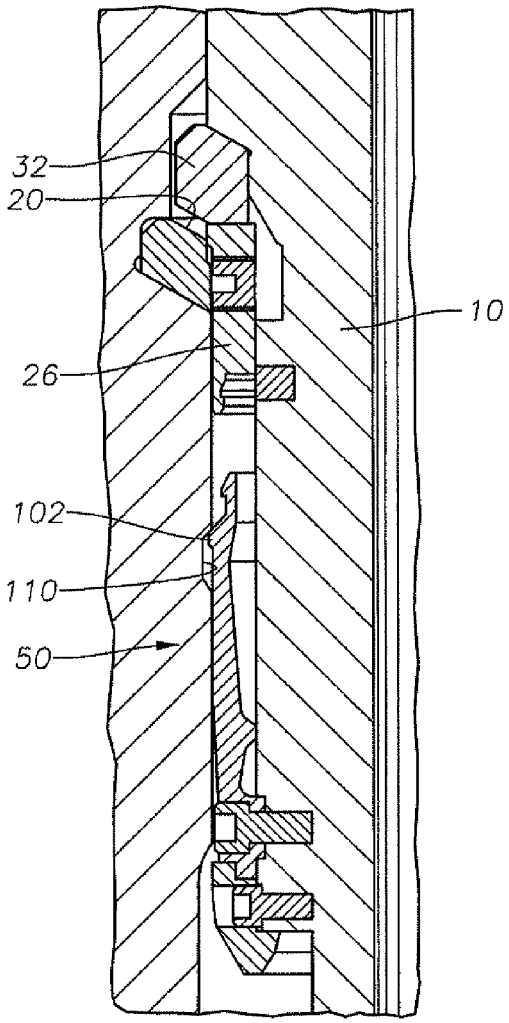
Figure 5C:
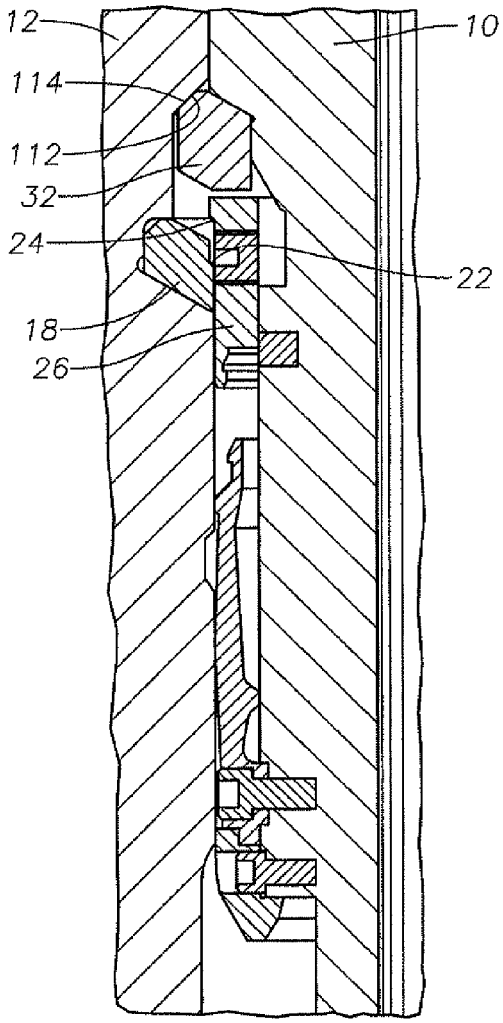
Figure 5D:
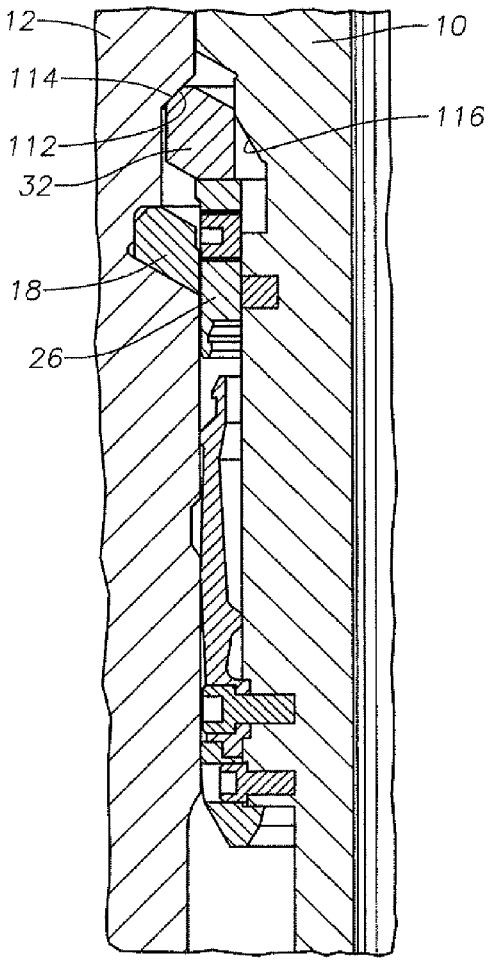
Figure 5E:
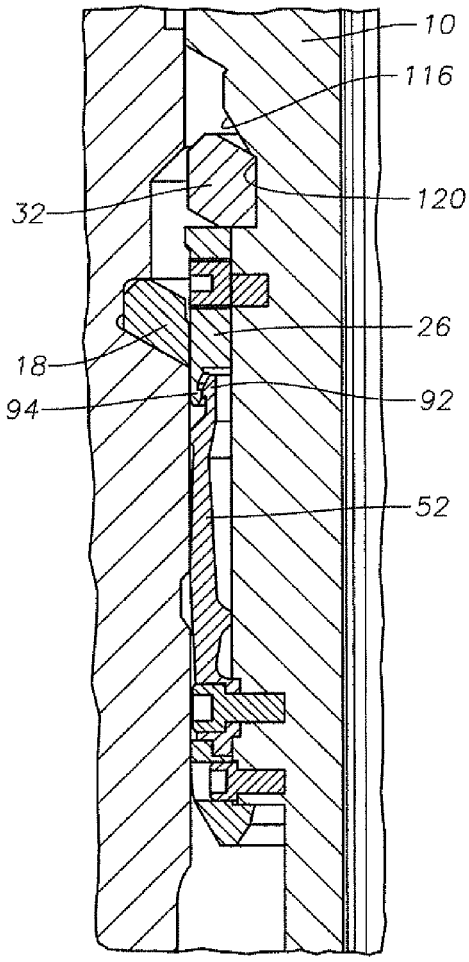

If needed, the casing hanger 10 may be retrieved from within the wellhead housing 12. FIGS. 5A-5E illustrate a sequence for retrieving the casing hanger 10 by deactivation of the activation ring 26. A running tool (not shown) may be used to unset the casing load ring 32 from the position shown in FIG. 5A. As the casing hanger 10 moves upward, as shown in FIG. 5B, the pad 102 on the exterior of the finger 52 of the centralizing ring 50 interferes with a recess 110 formed on the bore 14 of the wellhead housing 12. This interference may be used to check the installation of the hanger 10 via overpull, which in an example embodiment may be calibrated at 100 kips. To fully disengage the pad 102 from the recess 110 and continue moving the hanger 10 upward, an upward force greater than the overpull force is applied to the hanger 10 as shown in FIG. 5B. In an example embodiment the upward force to move the hanger 10 is about 150 kips. The force is sufficient to overcome the interference and the weight of the casing (not shown) carried by the hanger 10. Sufficient friction exists between the activation ring 26 and the hanger 10 to cause the ring 26 to move upward sufficiently for the tag shoulder 24 on the ring 26 to lift off from the tag shoulder 22 on the housing load ring 18. Upward movement of the ring 26 also causes the upper surface of the ring 26 to contact the hanger load ring 32 and lift it off of the tapered shoulder 20 of the housing load ring 18. As shown in FIG. 5C, the casing hanger 10 continues to be raised until and upward facing shoulder 114 on the casing load ring 32 contacts a corresponding, downward facing shoulder 112 formed on the housing 12 and inclined relative to the bore axis. As the hanger 10 continues to be raised upward in this embodiment, the hanger load ring 32 encounters a downward sloping surface 116, along which the load ring 18 begins to move radially inward as it contracts to the retracted state, as shown in FIGS. 5D and 5E. When the hanger load ring 32 is completely retracted and retained within a pocket 120 (FIG. 5E) formed on the exterior of the casing hanger 10, the hook 92 aligns with hook 94; the casing hanger 10, together with the centralizing ring 50, activation ring 26, and housing load ring 32, may be retrieved from the wellhead housing 12.

Figure 6:
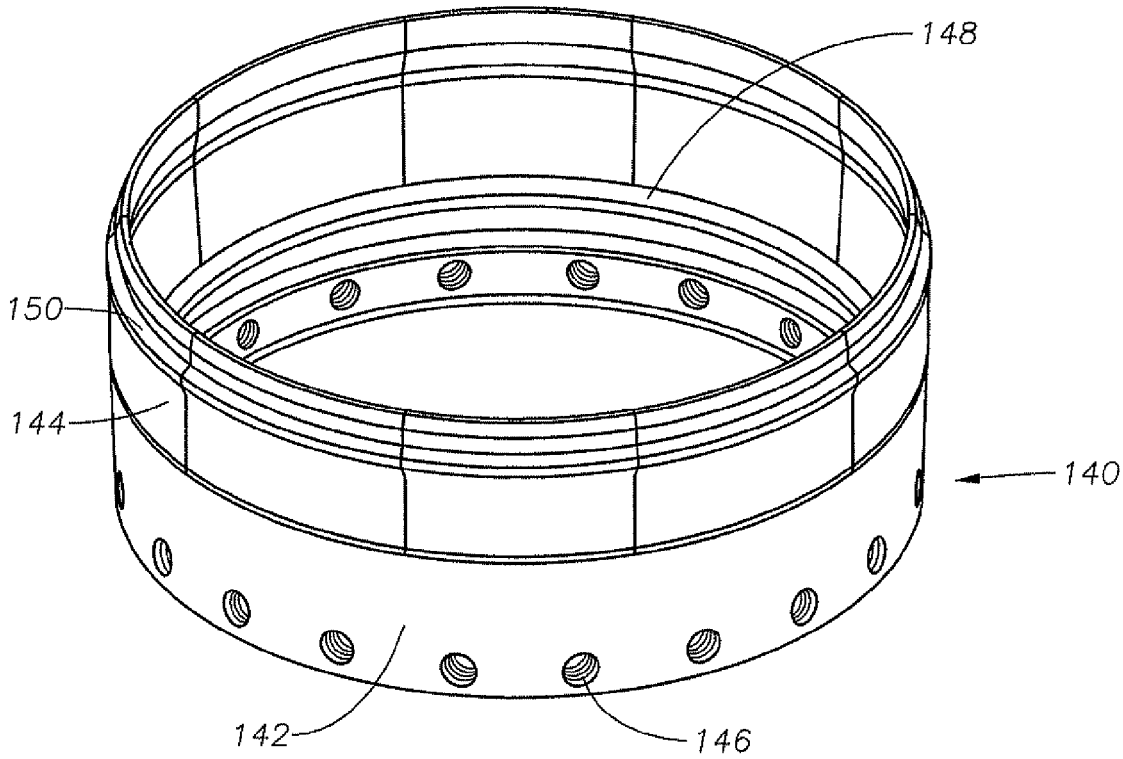
FIG. 6 is a perspective view of a centralizing ring with fingers extending from a base, in accordance with the invention.

In an alternative embodiment shown in FIG. 6, a centralizing ring 140 may be have a collet finger arrangement, with a plurality of fingers 144 having a common lower end 142. The lower end 142 of the centralizing ring 140 has bolt holes 146 around the circumference to allow fastening to the hanger 10 (FIG. 1). In contrast to the ring 50 of FIG. 1, the fingers 144 of the centralizing ring 140 are segmented on an upper end 150 and not along the entire axial length of the ring 140. Instead, the lower end 142 is a single member that is not segmented along its circumference. The spring effect in this embodiment may also be generated by a fulcrum 148 acting to cantilever the upper portion 150 of the fingers 144.

The invention has significant advantages. Premature activation of the activation ring is prevented by the preventing disengagement of the hook on the fingers until the correct diameter of within the wellhead housing is reached. Costly re-installation of the casing hanger is thus limited.

While the invention has been shown in only two of its forms, it should be apparent to those skilled in the art that it is not so limited but is susceptible to various changes without departing from the scope of the invention.

The invention claimed is:

1. A subsea wellhead assembly, comprising:

a housing having a bore containing at least one generally upward facing load shoulder;

a hanger that is lowered into the housing, the hanger having at least one downward facing load shoulder;

a first load ring that slidingly engages the downward facing load shoulder of the hanger and having a downward facing shoulder that transfers load to the upward facing load shoulder of the housing, wherein the load ring is carried by the hanger for movement between a retracted position, wherein the downward facing shoulder is spaced radially inward from the upward facing load shoulder of the housing, and an expanded position wherein the downward facing shoulder is in load transfer engagement with the upward facing load shoulder;

a centralizing ring fastened to the hanger below the load ring and having an outward facing portion that contacts the bore of the housing; and a hook formed at an upper end of the centralizing ring that exerts an outward force that delays the load ring from moving into the expanded position until the centralizing ring is compressed by a desired portion of the housing.

2. The assembly according to claim 1, wherein the centralizing ring comprises a plurality of fingers having a lower end fastened to the hanger and the hook is formed on a top end of the finger, the finger having an inward facing protrusion that contacts an outer surface of the hanger to create an outward force on the top end of the finger when the hook is restrained.

3. The assembly according to claim 1, wherein the upward facing load shoulder of the housing has a larger radial width than the downward facing load shoulder of the hanger.

4. The assembly according to claim 1, further comprising:

an upward facing tag shoulder formed in the bore or the housing; and an activation ring mounted to the hanger below the load ring, the activation ring having a downward facing tag shoulder that engages the upward facing tag shoulder while the hanger is being lowered into the well, stopping downward movement of the activation ring and the load ring, the continued downward movement of the hanger relative to the activation ring causing the load ring to move to the expanded position; wherein, the activation ring has a hook formed on a lower end that engages the hook formed on the upper end of the centralizing ring, the hook from the centralizing ring disengaging from the hook on the activation ring when the outward facing protrusion on the centralizing ring encounters the reduction in a diameter of the bore below the upward facing tag shoulder.

5. The assembly according to claim 4, further comprising:

a retaining member that secures the activation ring to the hanger for movement therewith until the tag shoulder engage each other.

6. The assembly according to claim 5, wherein:

disengagement of the hooks allows further downward movement of the hanger to shear the retaining member and allow hanger to move downward relative to the activation ring.

7. The assembly according to claim 1, further comprising:

a second load ring supported by the upward facing load shoulder on the bore having a generally upward fixing shoulder sliding engagement with the downward facing shoulder of the first load ring for transferring a load from the hanger to the housing;

an upward facing tag shoulder formed on an interior surface of the second load ring; and an activation ring mounted to the hanger below the second load ring, the activation ring having a downward facing tag shoulder that engages the upward facing tag shoulder on the first load ring while the hanger is being lowered into the well, stopping downward movement of the activation ring and the second load ring, the continued downward movement of the hanger relative to the activation ring causing the first load ring on the hanger to move to the expanded position and in contact with the second load ring on the housing; wherein, the activation ring has a hook formed on a lower end that engages the hook formed on the upper end of the centralizing ring, the hook from the centralizing ring disengaging from the hook on the activation ring when the outward facing protrusion on the centralizing ring encounters the reduction in a diameter of the bore below the upward facing tag shoulder.

8. The assembly according to claim 6, further comprising:

a retaining member that secures the activation ring to the hanger for movement therewith until the tag shoulders engage each other.

9. The assembly according to claim 8, wherein:

disengagement of the hooks allows further downward movement of the hanger to shear the retaining member and allow hanger to move downward relative to the activation ring.

10. The assembly according to claim 1, wherein:

at least one of upward facing load shoulder comprises a plurality of upward lacing load shoulders; and at least one of downward facing load shoulder comprises a plurality of downward facing load shoulders.

11. A subsea wellhead assembly, comprising:

a housing having a bore containing at least one conical generally upward facing load shoulder that inclines relative to an is of the bore;

a hanger that is lowered into the housing, the hanger having at least one conical downward facing load shoulder that inclines relative to the axis of the bore;

a load ring supported by the upward facing load shoulder on the bore having a generally upward facing shoulder for transferring a load from the hanger to the housing;

a split load ring having an upward facing shoulder that slidingly engages the downward facing load shoulder of the hanger and a downward facing shoulder that slidingly engages the upward facing shoulder of the load ring on the housing, wherein the split load ring is carried by the hanger for movement between a retracted position, wherein the downward facing shoulder is spaced radially inward from the upward facing load shoulder of the housing, and an expanded position wherein the downward facing shoulder is in engagement with the upward facing shoulder of the load ring on the housing;

a centralizing ring fastened to the hanger below the split load ring and having an outward facing protrusion that contacts the bore of the housing;

a hook formed at an upper end of the centralizing ring that exerts an outward force that delays the split load rings from moving into the expanded position until the protrusion on the centralizing ring encounters a reduction in a diameter of the bore of the housing;

an upward facing tag shoulder formed on an interior surface of the load ring of the housing; and an activation ring mounted to the hanger below the split load ring, the activation ring having a downward facing tag shoulder that engages the upward facing tag shoulder on the load ring while the hanger is being lowered into the well, stopping downward movement of the activation ring and the split load ring, the continued downward movement of the hanger relative to the activation ring causing the split load ring on the hanger to move to the expanded position and in contact with the load ring on the housing; wherein, the activation ring has a hook formed on a lower end that engages the hook formed on the upper end of the centralizing ring, the hook from the centralizing ring disengaging from the hook on the activation ring when the outward facing protrusion on the centralizing ring encounters the reduction in a diameter of the bore below the upward facing tag shoulder.

12. The assembly according to claim 11, wherein the centralizing ring comprises a plurality of fingers having a lower end fastened to the hanger and the hook is formed on a top end of the finger, the finger having an inward facing protrusion that contacts an outer surface of the hanger to create an outward force on the top end of the finger when the hook is restrained.

13. The assembly according to claim 11, wherein the upward lacing load shoulder of the housing has a larger radial width than the downward facing load shoulder of the hanger.

14. The assembly according to claim further comprising:

a retaining member that secures the activation ring to the hanger for movement therewith until the tag shoulder engage each other.

15. The assembly according to claim 14, wherein:

disengagement of the hooks allows further downward movement of the hanger to shear the retaining member and allow hanger to move downward relative to the activation ring.

16. The assembly according to claim 11, wherein:

at least one of upward facing load shoulder comprise a plurality of upward facing load shoulders; and at least one of downward facing load shoulder comprises a plurality of downward facing load shoulders.

17. A method for installing a subsea wellhead assembly, comprising:

providing a housing having a bore containing at least one conical generally upward facing load shoulders that inclines relative to an axis of the bore;

lowering a hanger into the housing, the hanger having at least one conical downward facing load shoulder that inclines relative to the axis of the bore;

delaying radial outward movement of a split load ring carried on the hanger until the hanger is lowered to the desired position within the housing, wherein the split load ring moves between a retracted and expanded position;

urging the split load ring outward to the expanded position to allow load from the hanger to be transferred to the housing; and moving the hanger downward relative to an activation ring, wherein the activation ring has a tag shoulder that contacts an upward facing tag shoulder in the bore of the housing to prevent downward movement of the activation ring and the split load ring;

wherein the split load ring has an upward facing shoulder that slidingly engages the downward facing load shoulder of the hanger and a downward facing shoulder that slidingly engages the upward facing load shoulder of the housing, wherein the split load ring is carried by the hanger for movement between the retracted position, wherein the downward facing shoulder is spaced radially inward from the upward facing load shoulder of the housing, and the expanded position wherein the downward facing shoulder is in load transfer engagement with the upward facing load shoulder;

a centralizing ring fastened to the hanger below the split load ring and having an outward facing protrusion that contacts the bore of the housing; and a hook formed at an upper end of the centralizing ring that exerts an outward force that delays the split load ring from moving into the expanded position until the protrusion on the centralizing ring encounters a reduction in a diameter of the bore of the housing.

18. The method of claim 17, wherein an upward force is applied to the hanger when set, to overcome the load on the hanger, unset the hanger, and retrieve the hanger.

* * * * *